US007674090B2

(12) United States Patent
Roberts et al.

(10) Patent No.: US 7,674,090 B2
(45) Date of Patent: Mar. 9, 2010

(54) STEAM TURBINE ROTORS

(75) Inventors: Bruce Wynn Roberts, Rugby (GB); Ian John Chilton, Lutterworth (GB)

(73) Assignee: Alstom Technology Ltd., Baden (CH)

( * ) Notice: Subject to any disclaimer, the term of this patent is extended or adjusted under 35 U.S.C. 154(b) by 692 days.

(21) Appl. No.: 11/388,289

(22) Filed: Mar. 24, 2006

(65) Prior Publication Data

US 2006/0228217 A1 Oct. 12, 2006

(30) Foreign Application Priority Data

Mar. 24, 2005 (GB) ..... 0505980.3

(51) Int. Cl.
*F01D 5/18* (2006.01)

(52) U.S. Cl. ..... 416/1; 416/201 R; 415/216.1

(58) Field of Classification Search ..... 415/200, 415/216.1; 416/1, 201 R
See application file for complete search history.

(56) References Cited

U.S. PATENT DOCUMENTS 4,962,586 A * 10/1990 Clark et al. ..... 29/889.2
5,746,579 A * 5/1998 Amos et al. ..... 416/204 A
6,074,169 A * 6/2000 Siga et al. ..... 416/241 R
6,152,697 A * 11/2000 Konishi et al. ..... 416/213 R
6,398,504 B1 * 6/2002 Arai et al. ..... 416/241 R
6,499,946 B1 * 12/2002 Yamada et al. ..... 415/199.4

FOREIGN PATENT DOCUMENTS

GB 416 033 9/1934
GB 416033 9/1934

OTHER PUBLICATIONS

Search Report for GB0505980.3 dated Aug. 11, 2005.

* cited by examiner

*Primary Examiner*—Edward Look
*Assistant Examiner*—Aaron R Eastman
(74) *Attorney, Agent, or Firm*—Darby & Darby

(57) ABSTRACT

A steam turbine rotor has at least a first stage and a last stage. The rotor is optimised for operation in a wet steam environment at steam temperatures of less than 300° C. by being made more resistant to stress corrosion cracking (SCC). The yield strength of the rotor varies along its axial length such that the yield strength of the rotor in the region of the last turbine stage is more than the yield strength of the rotor in the region of at least one earlier turbine stage.

10 Claims, 2 Drawing Sheets

STEAM TURBINE ROTORS

Priority is claimed to Great Britain Patent Application No. GB 0505980.3, filed on Mar. 24, 2005, the entire disclosure of which is incorporated by reference herein.

The present invention relates to rotors for use in steam turbines that operate at temperatures less than 300° C., and in particular to rotors that operate in wet steam and so require improved resistance to stress corrosion cracking (SCC).

BACKGROUND

Steam turbine rotors operating at low temperatures in wet steam can suffer from the problem of stress corrosion cracking (SCC). The problem has been particularly associated with rotors having shrunk-on discs but it also occurs in monobloc and welded rotors. The main influences for SCC initiation and propagation are (i) the yield strength (often defined as the indication of the maximum stress that can be developed in a material without causing significant plastic deformation) of the rotor material, (ii) the operating stress of the rotor, and (iii) the temperature and operating environment of the rotor. For a given temperature, the stress required for SCC initiation in steam turbine rotor steel increases as the yield strength of the material decreases. Similarly, for a given yield strength, the stress required for SCC initiation decreases as the temperature increases. It is therefore possible to produce a family of threshold curves for any particular steam turbine rotor that interrelate the yield strength of the material, component stress and the operating temperature. If the rotor of a particular yield strength is operated at stresses and/or temperatures that exceed its particular threshold curve then it is considered vulnerable to SCC.

The known practice in the steam turbine industry is to heat treat monobloc and welded rotors for low temperature application in wet steam so that they have uniform yield strength throughout. However, the strength needed to support the moving blades of the last, large diameter turbine stage is usually significantly greater than the strength needed to support the moving blades of the earlier, smaller diameter turbine stages located upstream. Not only does this mean that the parts of the rotor that support the earlier turbine stages are "over-engineered" in terms of their yield strength, it is also the case that these parts can be more vulnerable to SCC because they are operating at a higher temperature and in a harsher wet steam environment. As a result, the parts of the conventional monobloc and welded rotors that support the moving blades of the earlier turbine stages can be particularly vulnerable to SCC initiation and propagation.

SUMMARY OF THE INVENTION

The present invention provides a steam turbine rotor optimised for operation in a wet steam environment at steam temperatures of less than 300° C., the rotor having respective regions for mounting thereon of a last stage of moving blades and at least an earlier stage of moving blades, wherein the yield strength of the steam turbine rotor in the region of the last stage of moving blades is more than the yield strength of the steam turbine rotor in the region of the earlier stage of moving blades.

Those skilled in the art will appreciate that the turbine stage located at the downstream or exit end of the steam path is referred to as the last turbine stage and turbine stages located upstream of the last stage, i.e., nearer the entry end of the steam path, are referred to as earlier turbine stages. In cases where the steam is dry at entry to the turbine but becomes wet by the time it has expanded through one or more stages, the earlier turbine stage of moving blades referred to in the preceding paragraph will be the first stage that experiences wet steam. In cases where the steam is wet at entry to the turbine, the earlier turbine stage of moving blades referred to in the preceding paragraph will be the first stage of moving blades.

The invention enables manufacture of a steam turbine rotor with a non-uniform yield strength without significant increases in the cost of production.

Unlike known monobloc and welded rotors used in low temperature, low pressure steam turbines, the steam turbine rotor of the present invention does not have uniform yield strength along its axial length. Instead, the yield strength is different in different regions of the rotor corresponding to different turbine stages. For example, if the rotor is configured for mounting thereon of at least one intermediate stage of moving blades between the last stage of moving blades and the earlier stage of moving blades, then the regions of the rotor corresponding to the earlier and intermediate stages can be designed to have the same yield strength as each other but a lower yield strength than the last stage. Alternatively, the regions can have different yield strengths, with the yield strength of the regions increasing in the downstream direction of the steam path. In this case, the yield strength of the steam turbine rotor in the region of an intermediate stage of moving blades would have a value between the yield strengths of the steam turbine rotor in the regions of the earlier and last stages of moving blades, respectively. In the case of a rotor configured for three turbine stages, with the first turbine stage expected to operate in wet steam, the yield strength of the steam turbine rotor in the region of the first turbine stage may be less than the yield strength of the steam turbine rotor in the region of the second turbine stage, and the yield strength of the steam turbine rotor in the region of the second turbine stage may be less than the yield strength of the steam turbine rotor in the region of the last turbine stage.

In a preferred embodiment of the invention, the steam turbine rotor comprises a plurality of forged discs welded together in axial series, with each forged disc being configured for mounting thereon of at least one stage of moving blades. If all the forged discs are composed of the same material, different yield strengths of the steam turbine rotor in the regions of the different stages can be achieved by subjecting the corresponding discs to different heat treatments after they have been forged to shape but before welding together.

Different yield strengths of the steam turbine rotor in the regions of the different stages may also be achieved by making the corresponding discs of alloy materials having differing chemistries. In particular, lower strength material can be used for the disc forgings associated with the earlier turbine stages. The discs may be subjected to differing heat treatments after forging but before welding in order to adjust their yield strengths correctly.

In another embodiment of the invention, the steam turbine rotor can be of a monobloc construction in which the rotor is made from a single forging, which is then machined to accommodate the moving blades. In this case, the required variation in the yield strength of the individual regions can be achieved by localised heat treatment (e.g., by induction or resistance heating) of the rotor region at which the moving blades are to be mounted, i.e., different yield strengths of the steam turbine rotor in the regions of the different stages are achieved by subjecting said regions to different heat treatments.

The invention further provides a method of manufacturing a steam turbine rotor optimised for operation in a wet steam environment at steam temperatures of less than 300° C., the rotor having respective regions for mounting thereon of a last stage of moving blades and at least one earlier stage of moving blades, the method comprising the steps of:

at least one of selecting and heat treating the material in the region of the last stage of moving blades to achieve a first yield strength; and at least one of selecting and heat treating the material in the region of the earlier stage of moving blades to achieve a second yield strength, wherein the first yield strength is higher than the second yield strength.

In cases where the rotor has at least one intermediate region for mounting thereon of at least one intermediate stage of moving blades between the region of the last stage of moving blades and the region of the earlier stage of moving blades, the method may further comprise the step of selecting and/or heat treating the material in the intermediate region of the rotor to achieve a yield strength between the first and second yield strengths.

Lower yield strength in the regions of the steam turbine rotor that are associated with the earlier turbine stages (in other words, those that operate in a higher temperature wet environment) reduces the risk that stress corrosion cracking (SCC) initiation will occur in these regions. To make sure a particular region of the steam turbine rotor is not vulnerable to SCC, the yield strength for the region can be selected so that it does not exceed a threshold value based on the expected ranges of component stress and operating temperature for the region. Particular attention should be paid to peak stress levels anywhere in the wet steam path and the expected component stress levels at the blade attachment areas. An optimised yield strength, within the limits set by the threshold curve, will be as low as possible, while being sufficient to allow the region to support the moving blades of the associated turbine stage.

Further aspects of the invention will be apparent from a perusal of the following description and claims.

BRIEF DESCRIPTION OF THE DRAWINGS

Exemplary embodiments of the invention will now be described, with reference to the accompanying drawings, in which.

DETAILED DESCRIPTION

Figure 1:
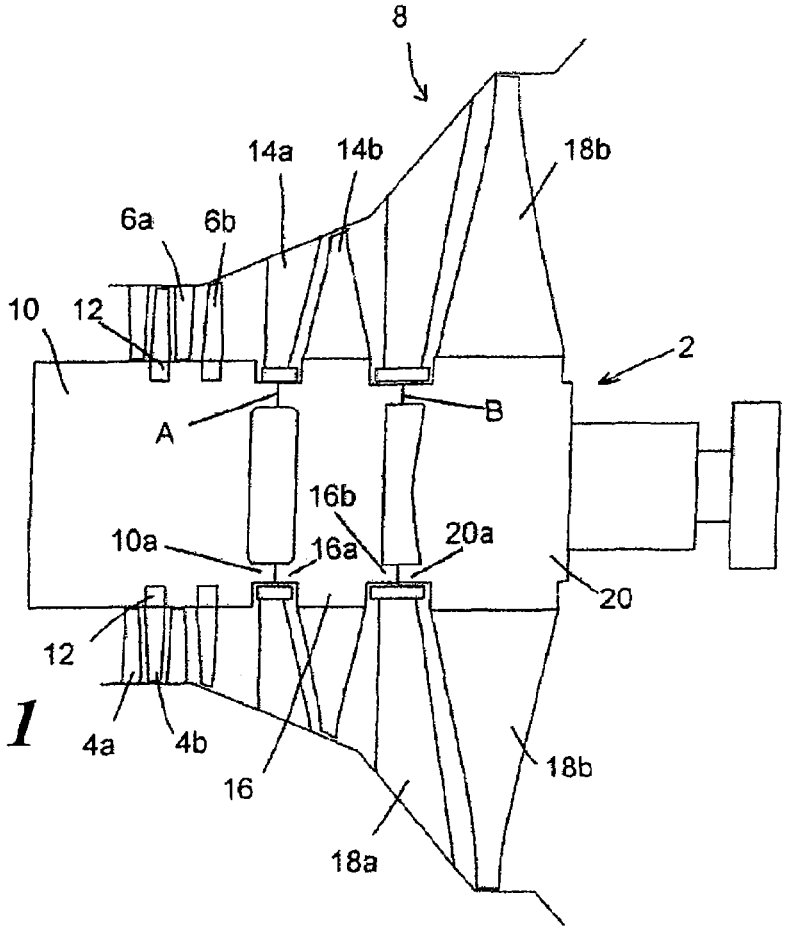
FIG. 1 is an axial cross section view of part of a steam turbine having a welded rotor in accordance with the present invention.

Referring to FIG. 1, a low pressure steam turbine of the reaction type includes a rotor 2 formed from a number of individual forged discs. In the present case there are first, second and third discs 10, 16 and 20, respectively. Examples of suitable disc materials are 2% CrNiMo, 3% NiCrMo, 3.5% NiCrMoV and 12% CrNiMo steel. The discs are welded together along annular joint lines A and B, which are provided by flanges or collars 16*a*, 16*b* on both sides of the middle disc and matching flanges or collars 10*a*, 20*a* on the right side of the first disc and the left side of the third disc respectively.

The steam expands through the steam turbine from left to right as drawn, in most cases entering the turbine in a dry state but at a pressure and temperature such that it rapidly becomes "wet steam", i.e., a mixture of water vapour and small droplets of water. However, in some circumstances, e.g., in steam turbines for some nuclear reactor systems, the steam is already wet at entry to the turbine. To extract power from the steam, the discs 10, 16 and 20 are provided with annular rows of moving turbine blades 4*b*, 6*b*, 14*b*, and 18*b*. Before each row of moving blades there is an annular row of fixed blades 4*a*, 6*a*, 14*a*, and 18*a*, whose purpose is to ensure the steam expands into the following moving blade rows under optimum aerodynamic and thermodynamic conditions. The combination of each row of moving blades with a preceding row of static blades comprises a turbine stage. The whole rotor therefore comprises several stages of turbine blades, four stages in this example. Hence, relatively higher pressure dry or wet steam enters the turbine at less than 300 degrees Celsius via fixed blades 4*a* and expands rapidly through the turbine stages 4*a*/4*b*, 6*a*/6*b*, 14*a*/14*b*, 18*a*/18*b*, becoming lower pressure wet steam at lower temperatures. In each case, the fixed blades 4*a*, 6*a*, 14*a*, and 18*a* are secured as known to an outer casing 8, the moving blades 4*b*, 6b, 14*b*, and 18*b* being secured to their respective discs 10, 16, 20 using known types of root fixings. Although the second and third discs typically each support only one row of moving blades 14*b*, 18*b*, the first disc 10 may support more than one row of moving turbine blades, in the present instance two rows 4*b*, 6*b*, each with their own root fixings 12.

As discussed above, discs 10, 16 and 20 operate at different temperatures within the steam turbine and hence according to the invention are manufactured to have different yield strengths suitable for operation in an overall wet steam environment. For example, the first and second turbine stages on disc 10 operate in higher temperature conditions. If the steam is also wet, it will be advantageous if the first disc 10 can have a low yield strength because this reduces the risk of stress corrosion crack (SCC) initiation and propagation (see below). The third turbine stage on disc 16 operates in lower temperature wet conditions than the first and second turbine stages. The yield strength of the second disc 16 can therefore be higher than that of the first disc 10 while still benefiting from a reduced risk of SCC. Of course, the yield strength of the first and second discs 10 and 16 must be sufficient to allow the moving blades of the first, second and third turbine stages to be properly supported.

The third disc 20 must support the large moving blades 18*b* of the last turbine stage and it must therefore have a higher yield strength. However, the last turbine stage operates at an even lower temperature than the first, second and third stages and this means that the yield strength of the third disc 20 can be higher without necessarily making it vulnerable to SCC. In general terms, the lower the disc material yield strength, the higher is the stress that can be applied to the disc without concern for the onset of SCC. Hence, the invention proposes lower strength disc forgings for higher temperature wet steam stages and higher strength forgings at lower temperature wet steam stages.

Compared with other types of steam turbine design (i.e., monobloc rotors and designs in which a forged disc is shrunk on to a central shaft) the type of turbine design shown in FIG. 1—comprising an axial series of forged and welded discs, in which the disc material is relatively lowly stressed by the rotational forces exerted by the blades—permits the use of materials with a lower yield strength. Typically, yield strengths of such discs will be in the range 550-800 MPa for the steels mentioned above, but in accordance with the invention, the actual permitted yield strength of each of the forged discs 10, 16 and 20 will be determined with reference to a threshold curve.

Figure 2:
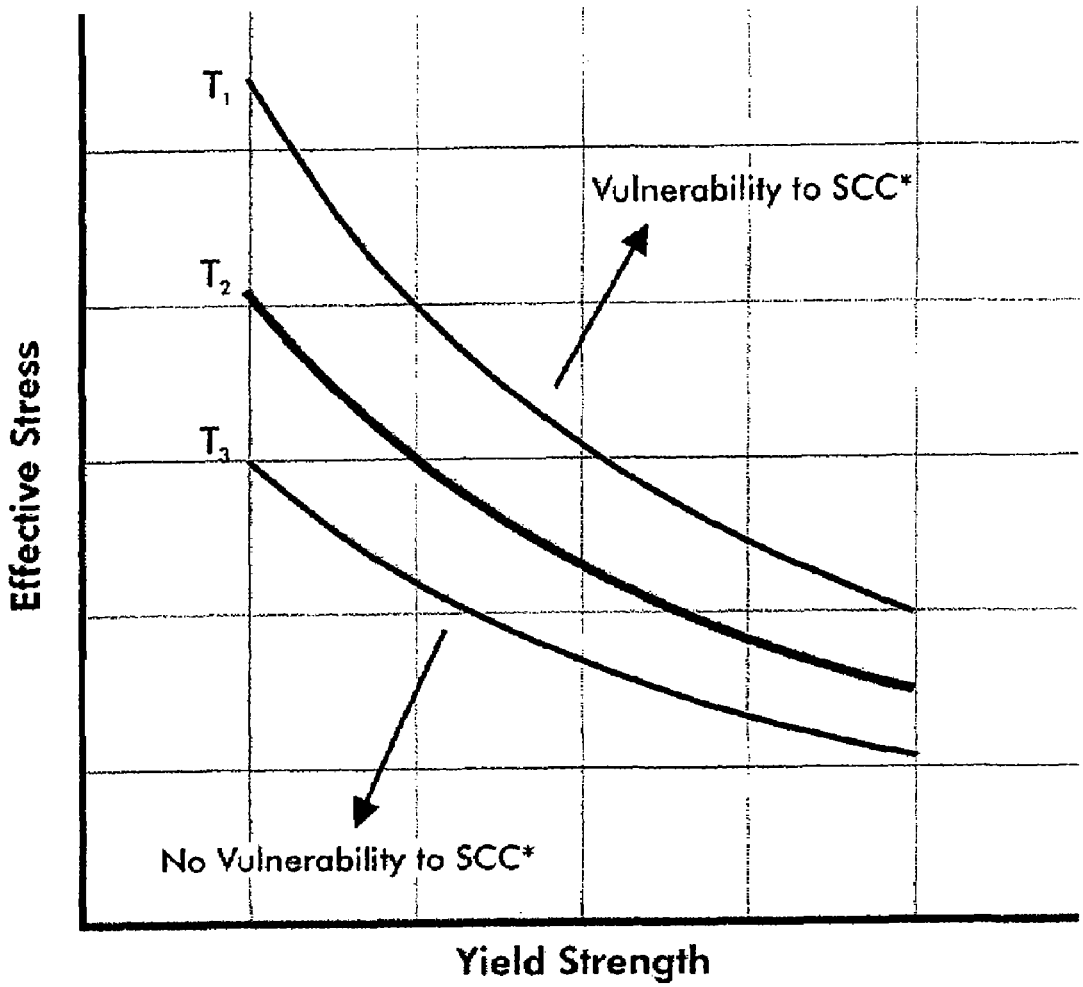
FIG. 2 is an illustration of a family of threshold curves that can be used to determine the yield strength of the individual disc forgings that make up the welded rotor of FIG. 1 or to determine the yield strength of the individual regions of a monobloc rotor of FIG. 3.

FIG. 2 shows a family of threshold curves for a particular disc material that represent a lower bound to SCC vulnerability. Each of the threshold curves is a plot of effective stress against yield strength for a fixed temperature. Temperature $T_1$ is lower than temperature $T_2$, which in turn is lower than temperature $T_3$. The operating temperature and effective stress levels will vary for each of the discs. It can be seen from FIG. 2 that if the first disc 10 is operating at temperature $T_3$ then it will be vulnerable to SCC initiation and propagation if the yield strength and effective stress coordinates lie to the right of (or in other words above) the lower threshold curve. However, if the yield strength and effective stress coordinate lies to the left of (i.e., below) the lower threshold curve then the first disc 10 will not be vulnerable to SCC. The yield strength of the first disc 10 can therefore be selected to make sure that the yield strength and effective stress coordinate lie comfortably on the correct (left) side of the threshold curve. If the third disc 20 is operating at the lower temperature $T_1$ then it will be readily appreciated that the third disc can have a much higher yield strength while still making sure that the yield strength and effective stress coordinate lies to the left of the upper threshold curve.

From the point of view of vulnerability to SCC initiation and propagation, it is clear that the yield strength can be selected such that the yield strength and effective stress coordinate lies anywhere to the left of the appropriate threshold curve, subject of course to the yield strength being sufficient to allow the moving blades in the relevant stage of the steam turbine to be properly supported.

It is convenient if discs 10, 16 and 20 are forged from the same material but are given different heat treatments so that they have the correct yield strength for their particular operating environment. However, it will be readily appreciated that the discs 10, 16 and 20 could also be forged from different materials. For example, the first disc 10 for the first and second turbine stages can be made of an alloy of a different chemical composition than that of the third disc 20 for the last turbine stage. The individual discs 10, 16 and 20 are then welded to each other to form the rotor 2 in the usual way.

The above description has focussed on a turbine rotor that is manufactured from two or more forged discs that are welded together in axial series. However, the invention is also applicable to other types of steam turbine rotors, particularly monobloc rotors, and similar considerations apply, except of course that the rotor can comprise only one material.

Figure 3:
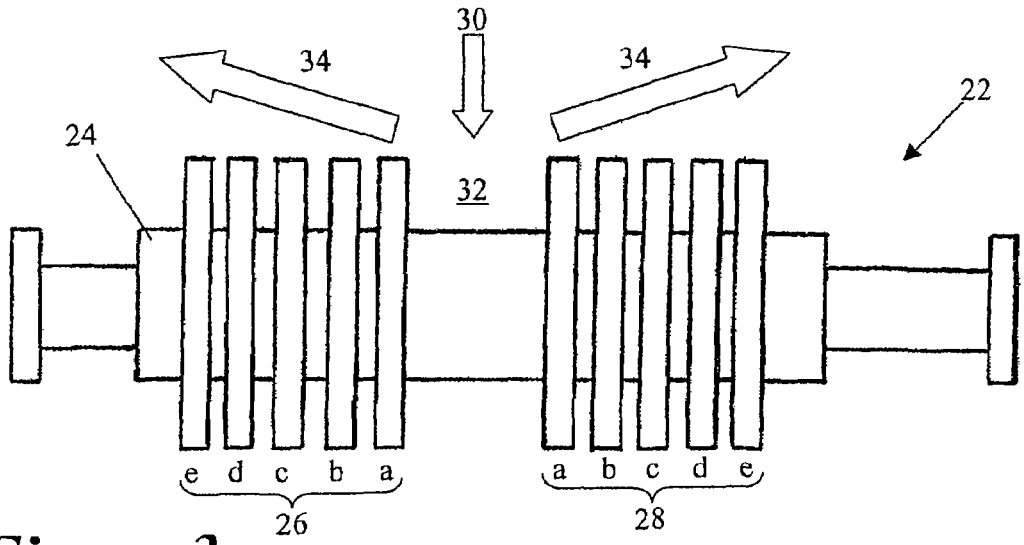
FIG. 3 is an axial cross-section view of a steam turbine monobloc rotor in accordance with the present invention.

FIG. 3 is a diagrammatic representation of a typical monobloc rotor 22 for use in an impulse type of steam turbine. The rotor 22 comprises a central shaft 24 and two sets of "rims" 26, 28, each set comprising five rims "a" to "e" in axial series, which are forged integrally with the shaft and are intended to support the various stages of moving blades (not shown) in the turbine. The number of rims define the number of stages that the steam turbine will have, and after final machining of the rotor 22 an annular row of moving blades is fitted to each of the rims 26*a-e*, 28*a-e*. The five stages of the turbine are formed by inserting an annular diaphragm of fixed blades (not shown) before each row of moving blades. In the present case, the rotor 22 is intended for a steam turbine of the double flow impulse type, in which the steam 30, at relatively high temperature and pressure, enters the turbine at a central location 32 relative to the axial length of the rotor 22 and expands through the stages of the turbine in both axial directions simultaneously, as indicated generally by the arrows 34.

In accordance with the invention, the rotor 22 is heat-treated after forging to achieve the required lower and higher tensile strengths in the regions of the rotor corresponding to selected higher and lower temperature wet steam stages. Examples of processes by which the required localised heat treatment may be applied to the rotor 22 are induction heating and resistance heating.

Assuming that the steam is already wet when it enters the turbine, the rims can be heat-treated so that, say, rims 26*a,b* and rims 28*a,b* in the higher temperature part of the turbine have a lower yield strength than rims 26*c-e* and rims 28*c-e* in the lower temperature part of the turbine. It would also be possible (if economically justifiable) to heat treat each of the rims so that the increase in yield strength is graduated in three or more steps. For example, the rims 26*a,b* and 28*a,b* that support the highest pressure/temperature wet steam stages could have the lowest yield strength, the rims that support the intermediate pressure/temperature wet steam stages 26*c,d* and 28*c,d* could have an intermediate yield strength and the rims 26*e*, 28*e* that support the lowest pressure/temperature wet steam stage could have the highest yield strength.

On the other hand, if the steam is not wet when it enters the turbine, but becomes wet by the stage corresponding to rims 26*c*, 28*c*, the rims can be heat-treated so that, say, rims 26*c,d* and rims 28*c,d* in the higher temperature wet steam part of the turbine have a lower yield strength than rims 26*e* and 28*e* in the lower temperature wet steam part of the turbine.

Hence, similarly to the rotor 2 of FIG. 1:

the required variation in the yield strength of the individual regions of rotor 22 can be achieved by heat treatment of the rotor location at which the moving blades are mounted, i.e., lower strength rims for higher temperature wet steam stages and higher strength rims for lower temperature wet steam stages; and the yield stresses for each region can be optimised by reference to a suitable family of effective stress/yield strength threshold curves for a particular rotor material, as exemplified by FIG. 2.

The present invention has been described above purely by way of example, and modifications can be made within the scope of the invention as claimed. The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the claims and drawings, may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

What is claimed is:

1. A steam turbine rotor comprising:

at least one first region including a plurality of forged discs formed from a first material having a first yield strength sufficient to prevent a vulnerability to stress corrosion cracking in a wet steam environment of the rotor at steam temperatures of less than 300° C. and configured to receive an earlier stage of moving blades and a second region including a plurality of forged discs formed from the first material having a second yield strength and configured to receive a last stage of moving blades, wherein the forged discs in the at least one first region are heat treated differently than the forged discs in the second region such that the second yield strength is greater than the first yield strength, and wherein the forged and heat treated discs in the at least one first region and the second region are welded together in axial series.

2. The steam turbine rotor as recited in claim 1, further comprising at least one intermediate region disposed between the second region and the at least one first region and having an intermediate yield strength, the intermediate region configured to receive an intermediate stage of moving blades, wherein the intermediate yield strength is less than the second yield strength and greater than the first yield strength.

3. The steam turbine rotor as recited in claim 2, wherein the second region, the first region and the intermediate region are composed of a plurality of forged discs welded together in axial series, each of the plurality of forged discs corresponding to one of the second, first, and intermediate regions.

4. The steam turbine rotor as recited in claim 3, wherein each of the plurality of forged discs is composed of the first material, and wherein the forged discs in the at least one intermediate region of the steam turbine rotor are heat treated differently than the forged discs in the at least one first region and the second region.

5. A method of manufacturing a steam turbine rotor having at least one first region configured to receive an earlier stage of moving blades and a second region configured to receive a last stage of moving blades, the method comprising:

heat treating a plurality of forged discs formed from a first material in the second region so as to achieve a second yield strength;

heat treating a plurality of forged discs formed from the first material in the at least one first region so as to achieve a first yield strength sufficient to prevent a vulnerability to stress corrosion cracking in a wet steam environment of the rotor at steam temperatures of less than 300° C., wherein the second yield strength is greater than the first yield strength; and welding the forged discs together in axial series to produce the steam turbine rotor having the regions of different yield strength.

6. The method as recited in claim 5, wherein the rotor includes at least one intermediate region disposed between the second region and the at least one first region, the at least one intermediate region being configured to receive at least one intermediate stage of moving blades, and wherein the method further comprises heat treating an intermediate material in the intermediate region so as to achieve an intermediate yield strength between the first and second yield strengths.

7. The method as recited in claim 6, wherein the intermediate material and the first material are the same.

8. The method as recited in claim 5, further comprising determining an optimum yield strength of each region of the steam turbine rotor by reference to threshold curves based on expected ranges of stress and operating temperature for each region of the steam turbine rotor.

9. A method of manufacturing a steam turbine rotor, the method comprising:

selecting the same material for all discs in the rotor, the material having a predetermined range of yield strengths in the wet steam environment of the finished rotor;

forging each disc to a desired shape;

heat treating the forged discs to achieve different yield strengths in accordance with a region of the rotor to be constituted by each disc such that at least the first region is not vulnerable to stress corrosion cracking in the wet steam environment of the rotor al steam temperatures of less than 300° C.; and welding the discs together in axial series to produce the steam turbine rotor having the regions of different yield strength.

10. A method of manufacturing a steam turbine rotor, the method comprising:

selecting at least first and second different disc materials, the first material having a lower yield strength than the second material in the wet steam environment of the finished rotor;

forging said first disc material into the disc corresponding to the second region of the rotor;

forging said second disc material into at least one disc corresponding to the at least one first region of the rotor;

heat treating the forged discs separately to produce the regions of different yield strength such that at least the first region is not vulnerable to stress corrosion cracking in the wet steam environment of the rotor at steam temperatures of less than 300° C.; and welding the discs together in axial series to produce the steam turbine rotor.

* * * * *